US010227828B2

(12) United States Patent
Zhao et al.

(10) Patent No.: US 10,227,828 B2
(45) Date of Patent: Mar. 12, 2019

(54) ULTRA-HIGH TOUGHNESS AND HIGH STRENGTH DRILL PIPE AND MANUFACTURING PROCESS THEREOF

(71) Applicant: BAOSHAN IRON & STEEL CO., LTD., Shanghai (CN)

(72) Inventors: Peng Zhao, Shanghai (CN); Jie Yu, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 300 days.

(21) Appl. No.: 14/422,864

(22) PCT Filed: Aug. 21, 2013

(86) PCT No.: PCT/CN2013/081922

§ 371 (c)(1),
(2) Date: Feb. 20, 2015

(87) PCT Pub. No.: WO2014/029328

PCT Pub. Date: Feb. 27, 2014

(65) Prior Publication Data

US 2015/0226014 A1 Aug. 13, 2015

(30) Foreign Application Priority Data

Aug. 21, 2012 (CN) ..... 2012 1 0299488

(51) Int. Cl.

| | |
|---|---|
| ***C22C 38/22*** | (2006.01) |
| ***C22C 38/24*** | (2006.01) |
| ***C22C 38/26*** | (2006.01) |
| ***C21D 8/10*** | (2006.01) |
| ***C21D 9/08*** | (2006.01) |
| ***C21D 9/14*** | (2006.01) |
| ***C21D 6/00*** | (2006.01) |
| ***C21D 1/18*** | (2006.01) |
| ***E21B 17/00*** | (2006.01) |
| ***C22C 38/02*** | (2006.01) |
| ***C22C 38/04*** | (2006.01) |
| ***C21D 1/56*** | (2006.01) |

(52) U.S. Cl.

CPC ..... *E21B 17/00* (2013.01); *C21D 1/18* (2013.01); *C21D 1/56* (2013.01); *C21D 6/002* (2013.01); *C21D 6/005* (2013.01); *C21D 6/008* (2013.01); *C21D 8/105* (2013.01); *C21D 9/08* (2013.01); *C21D 9/085* (2013.01); *C21D 9/14* (2013.01); *C22C 38/02* (2013.01); *C22C 38/04* (2013.01); *C22C 38/22* (2013.01); *C22C 38/24* (2013.01); *C22C 38/26* (2013.01)

(58) Field of Classification Search

None

See application file for complete search history.

(56) References Cited

U.S. PATENT DOCUMENTS 9,340,847 B2 * 5/2016 Altschuler ..... C21D 8/0236

FOREIGN PATENT DOCUMENTS

| | | | |
|---|---|---|---|
| CA | 2743552 | A1 | 6/2010 |
| CA | 2798852 | A1 | 12/2011 |
| CA | 2843593 | A1 | 2/2013 |
| CN | 101117683 | A | 2/2008 |
| CN | 101570836 | A | 11/2009 |
| CN | 102140611 | A | 8/2011 |
| CN | 102330027 | A | 1/2012 |
| CN | 102787274 | A | 11/2012 |
| JP | 61-272351 | A | 12/1986 |
| JP | 2000-297344 | A | 10/2000 |

OTHER PUBLICATIONS

Machine-English translation of JP06-116635, Yamane Yasuyoshi et al., Apr. 26, 1994.*
Machine-English translation of CN 1690241, Yin, Guanghong et al., Nov. 2, 2005.*
English abstract of CN 102251189, Li, Y. et al., Nov. 23, 2011.*
Machine-English translation of JP61-272351, Kobayashi Kunihiko et al., Dec. 2, 1986.*
International Search Report from PCT/CN2013/081922, dated Nov. 28, 2013 (English Translation).
CA2881904, "Office Action", dated Aug. 22, 2016, 4 pages.
CN201210299488.3, "Office Action and Search Report", dated Feb. 25, 2014, 7 pages.

* cited by examiner

*Primary Examiner* — Deborah Yee
(74) *Attorney, Agent, or Firm* — Kilpatrick Townsend & Stockton LLP

(57) ABSTRACT

The invention discloses a drill pipe having ultra-high toughness and high strength and comprising the following chemical elements in mass percentage: C: 0.24-0.30%, Si: 0.1-0.5%, Mn: 0.7-1.5%, Cr: 0.7-1.5%, Mo: 0.5-0.75%, V: 0.01-0.10%, Nb: 0.01-0.05%, P≤0.015%, S≤0.005%, and the balance of Fe and unavoidable impurities; and a process of manufacturing the drill pipe having ultra-high toughness and high strength, comprising: heating the drill pipe as a whole to 900-950° C.; subjecting the inner surface of the drill pipe to axial-flow water-spray cooling and the outer surface of the drill pipe to laminar-flow water-spray cooling while controlling the amount of the water sprayed at thickened ends of the drill pipe and that along the pipe body to be different from each other; and controlling the tempering temperature to be 650-675° C. The inventive drill pipe having ultra-high toughness and high strength has a longitudinal full-size impact toughness at −20° C. of at least 100 J and has a strength of 135 ksi.

11 Claims, No Drawings

ULTRA-HIGH TOUGHNESS AND HIGH STRENGTH DRILL PIPE AND MANUFACTURING PROCESS THEREOF

TECHNICAL FIELD

The invention relates to a metallic article and a manufacturing process thereof, particularly to a drill pipe and a manufacturing process thereof.

BACKGROUND ART

Drill pipes for petroleum and natural gas drilling operation are manufactured in accordance with the standards published by American Petroleum Institute (API). According to Specification for Drill Pipe (API SPEC 5DP), there are only four grades of steel for drill pipes, namely E, X, G, S, corresponding to four levels of strength, i.e. 75 ksi, 95 ksi, 105 ksi and 135 ksi, respectively. To guarantee the impact performance of a drill pipe, the longitudinal full-size impact toughness of the drill pipe at room temperature shall be at least 54 J as stipulated by American Petroleum Institute in the Specification for Drill Pipe (API SPEC 5DP).

The operating environment for a drill pipe is getting increasingly harsher along with the development of the petroleum industry, such that an API standard drill pipe can no longer meet the progressively rigorous requirements of the drilling operation. In recent years, as deep and ultra-deep wells are developed, even higher requirements are imposed on the performances of a drill pipe. As such, the material of the drill pipe needs not only high strength, but also sufficient toughness reserve. Only in this way can it endure forced tension, forced torsion, impact vibration and the action of various alternate loads in overload operation, and be adapted to the requirements of using the dill pipe under a variety of special operating conditions. Hence, the standard of at least 54 J of longitudinal full-size impact toughness at room temperature specified for grade S drill pipes according to Specification for Drill Pipe (API SPEC 5DP) of American Petroleum Institute cannot satisfy the more and more rigorous requirements of the drilling operation any longer. Therefore, American Petroleum Institute proposes the performance requirements for grade PSL3 drill pipes in the standards: at least 100 J of longitudinal full-size impact toughness for grade S drill pipes at −20° C., i.e. the performance requirements of drill pipes having ultra-high toughness and high strength.

A Chinese patent application literature titled "High-strength Petroleum Drill Pipe and Manufacturing Process Thereof" (publication number: CN1690241A; publication date: Nov. 2, 2005) discloses a high-strength drill pipe having the following chemical composition in mass percentage: C: 0.20-0.30%; Si: 0.1-0.5%; Mn: 0.7-1.5%; Cr: 0.7-1.5%; Mo: 0.1-0.4%; V: 0.01-0.15%; and the balance of Fe and unavoidable impurities. A grade S drill pipe in conformity with Specification for Drill Pipe (API SPEC 5DP) of American Petroleum Institute may be made according to this patent application, wherein the impact strength of the pipe meets the requirement of at least 54 J of longitudinal full-size impact toughness at room temperature.

SUMMARY

The object of the invention is to provide a high-strength drill pipe and a manufacturing process thereof, wherein the high-strength drill pipe meets the requirement of grade S ultra-high toughness, i.e. at least 100 J of longitudinal full-size impact toughness at −20° C. as stipulated in Specification for Drill Pipe (API SPEC 5DP) of American Petroleum Institute, such that it can work in wells under harsh operating conditions, such as deep wells, ultra-deep wells, horizontal wells, extended reach wells and the like.

To fulfill this object of the invention, the invention provides a drill pipe having ultra-high toughness and high strength, and comprising the following chemical elements in mass percentage: C: 0.24-0.30%, Si: 0.1-0.5%, Mn: 0.7-1.5%, Cr: 0.7-1.5%, Mo: 0.5-0.75%, V: 0.01-0.10%, Nb: 0.01-0.05%, P≤0.015%, S≤0.005%, and the balance of Fe and unavoidable impurities.

In the invention, all percentages are based on mass unless otherwise stated.

The design of the chemical composition of the drill pipe having ultra-high toughness and high strength according to the invention is based on the following principle:

C: C is a carbide-forming element and may increase the strength of steel. If the C content is too low, the effect is not obvious; if the C content is too high, the toughness of steel will be decreased badly, and quenching cracks may probably occur. Therefore, the C content in the invention is controlled in the range of 0.24%-0.30%, preferably 0.25%-0.29%, more preferably 0.26%-0.28%.

Si: Si is an element that must be incorporated to improve the casting performance. However, an unduly high content will increase the brittleness of steel. Hence, the Si content in the invention is controlled in the range of 0.1-0.5%, preferably 0.24-0.38%, more preferably 0.27-0.36%.

Mn: Mn is an austenite-forming element, which delays conversion of austenite to ferrite and bainite during high temperature cooling by stabilizing the austenitic structure, such that more quenched martensite is obtained and the hardenability of steel is increased. If the Mn content is less than 0.7%, the effect in increasing hardenability is not obvious; if the Mn content is more than 1.5%, austenite will be so stable that the amount of residual austenite after quenching will be increased. Therefore, the Mn content in the invention is 0.7-1.5%, preferably 0.7-1.17%, more preferably 0.92-1.17%.

Cr: Cr is a carbide-forming element and may increase the strength and hardenability of steel. If its content is too low, the effect is not obvious; if the content is too high, the hardness of steel will be increased significantly. Therefore, the Cr content in the invention is in the range of 0.7-1.5%, preferably 0.95-1.22%.

Mo: The carbide formed from Mo is in the form of fine particles which will not lead to stress concentration in the microstructure, facilitating the increase of impact toughness. With regard to ribbon steel, the strength and tempering stability of the steel are increased mainly by carbide precipitation strengthening and solid solution strengthening. When the Mo content is high, in addition to formation of carbide of Mo, some of the redundant Mo forms solid solution in the matrix, and thus increases the tempering stability of steel by solid solution strengthening Increased tempering stability is desirable for increasing tempering temperature so as to decrease residual stress after heat treatment and increase impact toughness. However, since Mo is a noble element, excessively high content of Mo will increase production cost remarkably. In the technical solution of the invention, the Mo content is set in the range of 0.5-0.75%, preferably 0.6-0.75%, more preferably 0.61-0.72%, and most preferably 0.66-0.70%.

V: V can form a carbide, refine grains and increase the strength and toughness of steel. However, when its content increases up to a certain level, the further enhancement in this effect will no longer be remarkable. Additionally, because vanadium is a noble metal having a very high price, the production cost will be increased by the addition of vanadium. Therefore, the V content in the invention is controlled in the range of 0.01-0.10%, preferably 0.05-0.09%, more preferably 0.05-0.08%.

Nb: Nb can refine grains, form a carbide, and increase the strength and toughness of steel. However, when its content increases up to a certain level, the resultant effect will no longer be obvious. Additionally, its price is high. Therefore, its content in the invention is controlled in the range of 0.01-0.05%, preferably 0.02-0.04%.

P: Phosphorus is an impurity element which shall be minimized. In the invention, a phosphorus content of more than 0.015% will increase microsegregation which deteriorates the impact toughness of steel. Therefore, the phosphorus content in the invention shall be controlled to be no higher than 0.015%.

S: Sulfur is also an impurity element which shall be minimized. In the invention, if the sulfur content exceeds 0.005%, the amount of sulfides will be increased, which will deteriorates the impact toughness of steel. Therefore, the sulfur content in the invention shall be controlled to be no higher than 0.005%.

In the technical solution of the invention, the inventors add a relatively high content of Mo. In addition, Nb and V elements are added. These metal elements not only refine grains, but also increase the strength of the drill pipe, such that the strength of the drill pipe reaches a level of 135 ksi at relatively high temperature during subsequent tempering.

Correspondingly, the invention also provides a process of manufacturing the above high-strength drill pipe, comprising: manufacturing a drill pipe having the above elemental composition in mass percentage, and then subjecting it to quenching and tempering operations. In the quenching step, firstly the drill pipe as a whole is heated to a temperature of 900-950° C., then the inner surface of the drill pipe is subjected to axial-flow water-spray cooling and the outer surface of the drill pipe is subjected to laminar-flow water-spray cooling. At the same time, the amount of the water sprayed at thickened ends of the drill pipe and that along the pipe body are controlled to be different from each other, so that the pipe body and the thickened ends having different wall thicknesses have substantially the same cooling rate. In the tempering step, the tempering temperature is controlled at 650-675° C.

In a preferred embodiment of the invention, in the quenching step, the drill pipe as a whole is heated to a temperature of 910-940° C., preferably to a temperature of 920-940° C., more preferably to a temperature of 910-930° C.

In another preferred embodiment of the invention, in the tempering step, the tempering temperature is controlled to be 650-670° C. or 660-670° C.

In the invention, in the quenching step, the pipe body and the thickened ends having different wall thicknesses are rendered to have substantially the same cooling rate by subjecting the inner surface of the drill pipe to axial-flow water-spray cooling and subjecting the outer surface of the drill pipe to laminar-flow water-spray cooling, and at the same time, controlling the amount of the water sprayed at the thickened ends of the drill pipe and that along the pipe body to be different from each other. The term "substantially" means the difference between the cooling rates of the pipe body and the thickened ends having different wall thicknesses is equal to or less than 10%, preferably equal to or less than 5%.

In the technical solution of the invention, the inventors subject the ends of the drill pipe to thickening treatment to prepare a thickened drill pipe body. The thickened drill pipe body is heated as a whole to a temperature of 900-950° C. and then placed on a rotating quenching table. While the steel pipe is rotating, the inner surface of the drill pipe is subjected to axial-flow water-spray cooling and the outer surface of the drill pipe is subjected to laminar-flow water-spray cooling. The pipe drill body and the thickened ends having different wall thicknesses are rendered to have substantially the same cooling rate by controlling the amount of the water sprayed at the thickened ends of the drill pipe and that along the pipe body to be different from each other, so as to ensure that the drill pipe body and the thickened ends of the drill pipe have the same quenched microstructure. Finally, the drill pipe is subjected to tempering treatment at 650-675° C., such that the pipe body and the thickened ends have a mechanical strength of 135 ksi.

As compared with the prior art, the drill pipe having ultra-high toughness and high strength and the manufacturing process thereof according to the invention have the following beneficial effects:

While the strength of the drill pipe reaches 135 ksi, its longitudinal full-size impact toughness at −20° C. is 100 J or larger, which is far higher than the level for grade S drill pipes in Specification for Drill Pipe (API SPEC SDP) of American Petroleum Institute, satisfying the requirements of high demanding drilling operations in such wells as deep wells, ultra-deep wells, horizontal wells, extended reach wells and the like.

DETAILED DESCRIPTION OF THE INVENTION

The technical solution of the invention will be further illustrated with reference to the following specific examples and comparative examples.

EXAMPLES 1-6

The chemical element compositions of Examples 1-6 according to the invention and CrMnMo steel commonly used in the prior art (Comparative Example) are listed in Table 1.

TABLE 1

| | (wt %) | | | | | | | | |
|---|---|---|---|---|---|---|---|---|---|
| Designation | C | Si | Mn | Cr | Mo | V | Nb | P | S |
| Example 1 | 0.27 | 0.24 | 1.17 | 1.01 | 0.68 | 0.05 | 0.02 | 0.010 | 0.002 |
| Example 2 | 0.25 | 0.32 | 1.02 | 1.12 | 0.74 | 0.09 | 0.03 | 0.007 | 0.002 |
| Example 3 | 0.29 | 0.36 | 1.10 | 1.17 | 0.61 | 0.07 | 0.04 | 0.008 | 0.001 |
| Example 4 | 0.28 | 0.38 | 0.95 | 1.20 | 0.66 | 0.08 | 0.03 | 0.009 | 0.001 |
| Example 5 | 0.26 | 0.30 | 1.15 | 0.95 | 0.72 | 0.06 | 0.04 | 0.006 | 0.002 |

TABLE 1-continued

| | (wt %) | | | | | | | | |
|---|---|---|---|---|---|---|---|---|---|
| Designation | C | Si | Mn | Cr | Mo | V | Nb | P | S |
| Example 6 | 0.27 | 0.27 | 0.92 | 1.22 | 0.70 | 0.07 | 0.02 | 0.008 | 0.002 |
| Comparative Example | 0.26 | 0.27 | 1.02 | 1.00 | 0.34 | 0.07 | / | 0.007 | 0.002 |

The inventive drill pipes having ultra-high toughness and high strength were manufactured using the following steps (the detailed process parameters and mechanical properties of Examples 1-6 are listed in Table 2):

First, the ends of the drill pipe were thickened to form a thickened drill pipe body. The drill pipe as a whole was heated to a temperature of 900-950° C. The drill pipe as a whole was placed on a rotating quenching table. While the steel pipe was rotating, the inner surface of the drill pipe was subjected to axial-flow water-spray cooling and the outer surface of the drill pipe was subjected to laminar-flow water-spray cooling. At the same time, the amount of the water sprayed at the thickened ends of the drill pipe and that along the pipe body were controlled to be different from each other, so that the pipe body and the thickened ends having different wall thicknesses had substantially the same cooling rate to ensure that the pipe body and the thickened ends of the drill pipe had identical quenched microstructure. Finally, the drill pipe was subjected to tempering treatment at 650-675° C., such that both the pipe body and the thickened ends had a desired mechanical strength of 135 ksi.

TABLE 2

| Designation | Quenching Temperature (° C.) | Tempering Temperature (° C.) | Yield Strength (MPa) | Tensile Strength (MPa) | Impact Toughness (J) L-10-20° C. |
|---|---|---|---|---|---|
| Example 1 | 920 | 665 | 1010 | 1090 | 128 |
| Example 2 | 920 | 675 | 975 | 1070 | 134 |
| Example 3 | 920 | 655 | 1060 | 1130 | 121 |
| Example 4 | 910 | 650 | 1070 | 1138 | 122 |
| Example 5 | 940 | 660 | 1020 | 1100 | 127 |
| Example 6 | 930 | 670 | 990 | 1090 | 130 |
| Comparative Example | 880 | 615 | 1010 | 1110 | 85 |

As known from Table 2, when the same strength of 135 ksi is achieved, the drill pipes having ultra-high toughness and high strength according to the technical solution of the invention have far higher tempering temperatures than that of the conventional 135 ksi drill pipe of the comparative example, such that the inventive drill pipes having ultra-high toughness and high strength have a longitudinal full-size impact toughness at −20° C. of at least 100 J, far higher than the impact toughness level of the conventional 135 ksi drill pipe. Hence, the inventive pipes are capable of long-term operation under harsh conditions where alternate stress, abrasion and collision occur frequently.

It is to be noted that the above specific examples of the invention are only exemplary. Obviously, the invention is not limited to the above examples. Rather, many variations can be made. All variations derived directly or contemplated from the disclosure of the invention by one skilled in the art fall within the protection scope of the invention.

What is claimed is:

1. A drill pipe having ultra-high toughness and high strength, and consisting of the following chemical elements in mass percentage:

C: 0.24-0.30%, Si: 0.1-0.5%, Mn: 0.92-1.5%, Cr: 0.7-1.5%, Mo: 0.5-0.75%, V: 0.01-0.10%, Nb: 0.01-0.05%, P≤0.015%, S≤0.005%, and the balance of Fe and unavoidable impurities;

while the strength of the drill pipe having ultra-high toughness and high strength reaches 135 ksi, its longitudinal full-size impact toughness at −20° C. is 100 J or larger;

wherein said drill pipe is manufactured by a process comprising the steps of:

forming a drill pipe having an inner and outer surface, a pipe body between thickened ends and said chemical element composition in mass percentage;

subjecting the drill pipe to a quenching step, wherein the drill pipe as a whole is heated to 900-950° C.; and then the inner surface of the drill pipe is subjected to axial-flow water-spray cooling and the outer surface of the drill pipe is subjected to laminar-flow water-spray cooling, with the amount of the water sprayed at thickened ends of the drill pipe and that along the pipe body being controlled to be different from each other, so that the pipe body and the thickened ends having different wall thicknesses have the same cooling rate; and subjecting the drill pipe to a tempering step, wherein the tempering temperature is controlled to be 650-675° C.

2. The drill pipe having ultra-high toughness and high strength according to claim 1, wherein the mass percentages of the chemical elements are:

C: 0.25-0.29%, Si: 0.24-0.38%, Mn: 0.92-1.17%, Cr: 0.95-1.22%, Mo: 0.6-0.75%, V: 0.05-0.09%, Nb: 0.02-0.04%, P≤0.015%, S≤0.005%, and the balance of Fe and unavoidable impurities.

3. The drill pipe having ultra-high toughness and high strength according to claim 1, wherein the mass percentages of the chemical elements are:

C: 0.26-0.28%, Si: 0.27-0.36%, Mn: 0.92-1.17%, Cr: 0.95-1.22%, Mo: 0.61-0.72%, V: 0.05-0.08%, Nb: 0.02-0.04%, P≤0.015%, S≤0.005%, and the balance of Fe and unavoidable impurities.

4. The drill pipe having ultra-high toughness and high strength according to claim 1, wherein the mass percentage of Mo is 0.66-0.70%.

5. A process of manufacturing the drill pipe having ultra-high toughness and high strength according to claim 1, comprising:

forming a drill pipe having an inner and outer surface, a pipe body between thicked ends and the desired chemical element composition in mass percentage;

subjecting the drill pipe to a quenching step, wherein the drill pipe as a whole is heated to 900-950° C.; and then the inner surface of the drill pipe is subjected to axial-flow water-spray cooling and the outer surface of the drill pipe is subjected to laminar-flow water-spray cooling, with the amount of the water sprayed at thickened ends of the drill pipe and that along the pipe body being controlled to be different from each other, so that the pipe body and the thickened ends having different wall thicknesses have the same cooling rate; and subjecting the drill pipe to a tempering step, wherein the tempering temperature is controlled to be 650-675° C.

6. The process according to claim 5, wherein the drill pipe as a whole is heated to 910-940° C., or 920-940° C., or 910-930° C. in the quenching step.

7. The process according to claim 5, wherein the tempering temperature is controlled to be 650-670° C. or 660-670° C. in the tempering step.

8. The process according to claim 5, wherein the amount of the water sprayed at the thickened ends of the drill pipe and that along the pipe body are controlled to be different from each other in the quenching step, so that the difference between the cooling rates of the pipe body and the thickened ends having different wall thicknesses is equal to or less than 10%, or equal to or less than 5%.

9. The process according to claim 5, wherein the drill pipe has the mass percentages of the chemical elements:

C: 0.25-0.29%, Si: 0.24-0.38%, Mn: 0.92-1.17%, Cr: 0.95-1.22%, Mo: 0.6-0.75%, V: 0.05-0.09%, Nb: 0.02-0.04%, P≤0.015%, S≤0.005%, and the balance of Fe and unavoidable impurities.

10. The process according to claim 5, wherein the drill pipe has the mass percentages of the chemical elements:

C: 0.26-0.28%, Si: 0.27-0.36%, Mn: 0.92-1.17%, Cr: 0.95-1.22%, Mo: 0.61-0.72%, V: 0.05-0.08%, Nb: 0.02-0.04%, P≤0.015%, S≤0.005%, and the balance of Fe and unavoidable impurities.

11. The process according to claim 5, wherein the drill pipe has a mass percentages of Mo of 0.66-0.70%.

* * * * *